United States Patent [19]

Hopland

[11] 4,011,900

[45] Mar. 15, 1977

[54] HATCH COVER ARRANGEMENTS

[75] Inventor: Moritz Hopland, Kleppesto, Norway

[73] Assignee: MacGregor International S.A., Basel, Switzerland

[22] Filed: Feb. 4, 1975

[21] Appl. No.: 546,874

[30] Foreign Application Priority Data

Feb. 12, 1974 Norway ..... 461/74

[52] U.S. Cl. ..... 160/188; 114/201 R

[51] Int. Cl.[2] ..... E05F 15/00

[58] Field of Search ..... 160/188; 114/201 R, 114/202, 203

[56] References Cited

UNITED STATES PATENTS

| | | | |
|---|---|---|---|
| 3,107,722 | 10/1963 | Larsson | 160/188 |
| 3,179,402 | 4/1965 | Hamilton | 160/188 UX |

FOREIGN PATENTS OR APPLICATIONS

| | | | |
|---|---|---|---|
| 987,549 | 3/1965 | United Kingdom | 114/202 |

*Primary Examiner*—Philip C. Kannan
*Attorney, Agent, or Firm*—McCormick, Paulding & Huber

[57] ABSTRACT

A hatch cover arrangement comprising cover sections directly hinged together in series and adapted to be pivoted from an active horizontal position above a hatch coaming bounding a hatch opening to an inactive, upwardly swung, vertical position at least partially outside the opening. A cover lifting device is arranged in opposite relation on each exposed longitudinal side of the cover and comprises two lifting cylinders each hinged at one end to a respective one of two adjacent cover sections and at the opposite end to a common hinge arm construction itself separately hinged to these sections. A wheel of the device is mounted for the support of the hinge arm construction between the latter and the longitudinal side of the cover at the junction between the adjacent cover sections. Pivoting of the cover sections to and from the inactive and active positions is accompanied by the rotation of the wheels of the two devices along longitudinal guides towards and away from one end of the hatch coaming. The main portion of each cover lifting device is arranged laterally outside the guide of the wheel thereof and the locations at which the lifting cylinders are hinged to their hinge arm construction are below the level of the guide.

7 Claims, 11 Drawing Figures

-FIG. 4.-
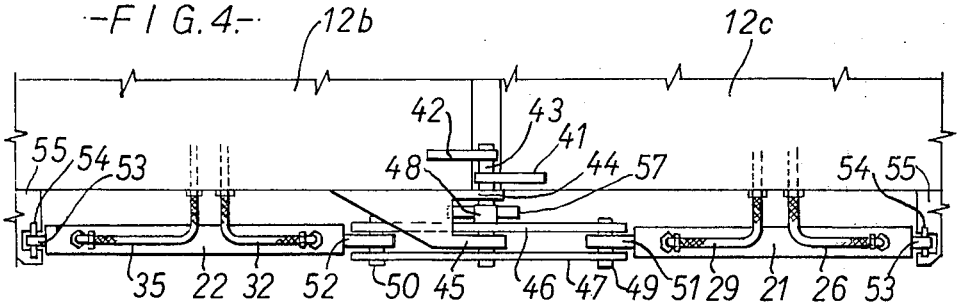
-FIG. 5.-
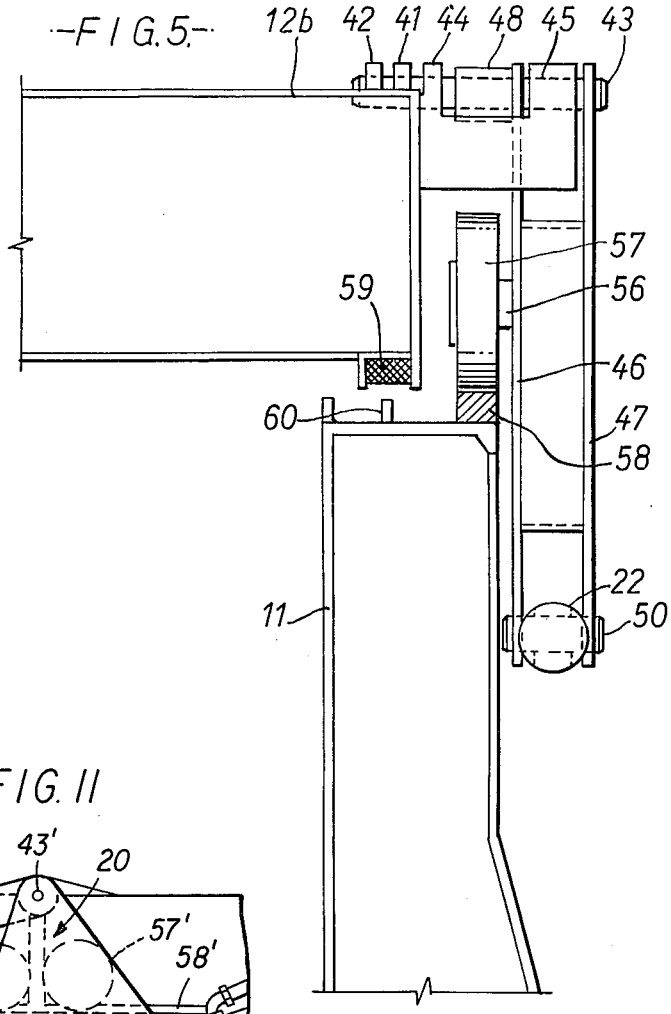
FIG. 11
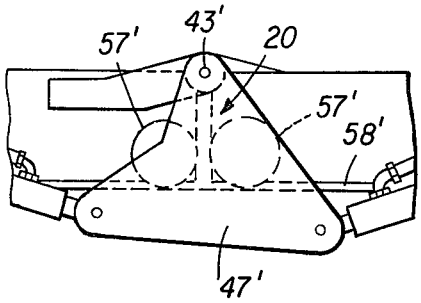

-FIG. 6.-
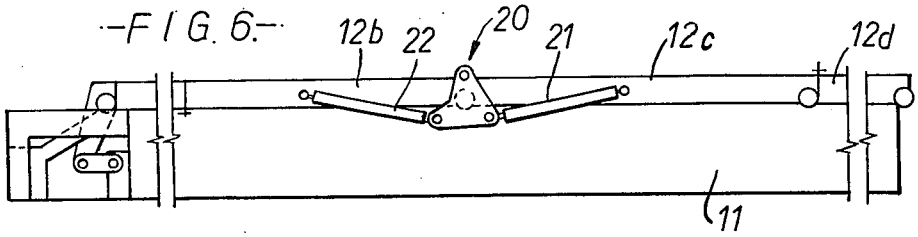
-FIG. 7.-
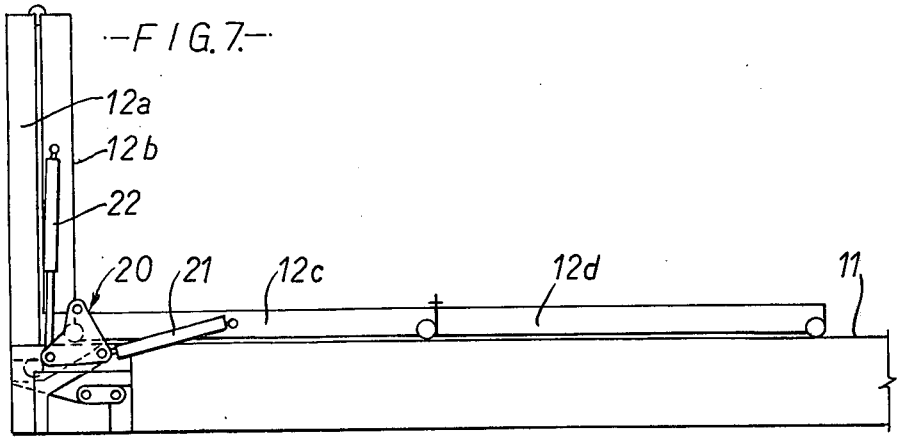
-FIG. 8.-
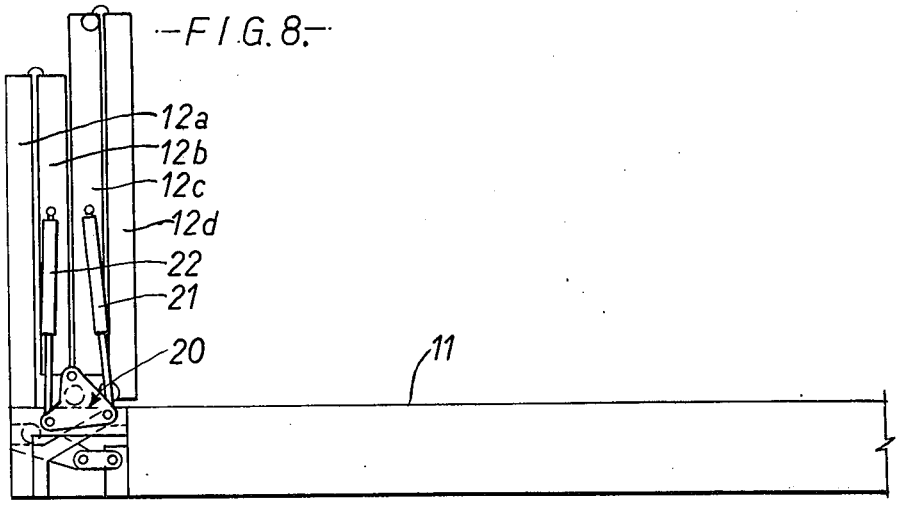

HATCH COVER ARRANGEMENTS

This invention relates to hatch cover arrangements.

From Norwegian Pat. No. 111,725, a hatch cover arrangement is known in which a cover lifting device is arranged vertically above the guide of support wheels, that is to say limited to the level above the guide of the support wheels. With respect to a desirably favourable attack angle for the lifting arms, this involves having lifting arms of limited length so that in the case where the lifting arm is constituted by a lifting cylinder, one is limited to using relatively small lifting cylinders. However, in practice there is a need for larger lifting cylinders than those which are possible in such a known solution.

In order to be able to achieve greater lifting forces than those which can be obtained by the solution according to this prior specification, there have been utilised several lifting cylinders in series in the breadth direction of the hatch cover. For example, with large hatches there have been utilised a number of seven lifting cylinders by the side of one another on respective sides of the pivotal axis of the hatch covers. Every cylinder which is arranged in the hatch cover within the opening of the hatch is, however, complicated to get at for inspection, repair and replacement. There is, therefore, a need to come forward with a solution in which, with especially large and heavy hatch covers, the placement of the lifting cylinders in the hatch cover within the opening of the hatch can be avoided.

According to the present invention a hatch cover arrangement comprises a cover made up of cover sections directly hinged together in series and adapted to be pivoted from an active horizontal position above a hatch coaming defining a hatch opening to an inactive, upwardly swung, vertical position at least partially outside said opening, a cover lifting device arranged in opposite relation on each exposed longitudinal side of said cover and comprising two lifting arms in combination with not more than two lifting cylinders, said lifting arms each being hingedly connected at one end to a respective one of two adjacent cover sections and at the opposite end to a hinge arm construction common to said arms which construction is separately hinged to said adjacent cover sections and a wheel mounted for the support of said hinge arm construction between the latter and said longitudinal side of said cover at the junction between said adjacent cover sections and designed for rotation along a guide extending longitudinally of said coaming, and means for actuating said not more than two lifting cylinders of said cover lifting device to cause said lifting arms to pivot the cover sections reversibly between said inactive and active positions while rotating said wheel along said guide towards and away from one end of said coaming, the common hinge construction and associated lifting arms of each cover lifting device being arranged laterally outside said guide and the locations at which said lifting arms are hingedly connected to said construction being below the level of said guide.

By arranging the cover lifting device laterally outside the guide at the hatch coaming with the hinge point of the lifting arms on the hinge arm construction at a suitable level below the guide, there is a possibility of being able to utilise arbitrarily large lifting cylinders in each lifting arm with the resulting possibility thereof of ready inspection, repair and replacement. In addition, there can be achived a simple standardisation of the cover lifting device by utilising only a pair of lifting arms on each side of the hatch cover section — independently of the size and thickness of the cover section. For example, in a standardised construction for the cover lifting device there can be mounted, as required, desirably large lifting cylinders in their respective arms.

Cover lifting devices are known in which there are utilised two lifting arms but where these are served by a common lifting cylinder, instead of the normal with a lifting cylinder for each lifting arm. Such a system can be adapted to the present invention without a concrete embodiment of this being illustrated.

In order that the invention can be more clearly understood, convenient embodiments thereof will now be described, by way of example, with reference to the accompanying drawings in which:

FIG. 1 is a perspective view of a ship's hatch coaming with a cover arrangement according to the invention mounted thereon in an active position, FIG. 2 is a schematic coupling diagram of the arrangement of FIG. 1 viewed from above, FIG. 3 is a cut-off side elevation of the arrangement of FIG. 1 on an enlarged scale, FIG. 4 is a cut-off plan of the same arrangement on an enlarged scale, FIG. 5 is a cut-off vertical cross-section of the same arrangement on a still larger scale, FIGS. 6–8 are cut-off side elevations of the same arrangement illustrating the hatch cover in three different positions during pivoting of the cover sections thereof from the horizontal to the vertical position.

FIG. 11 is a cut-off side elevation similar to FIG. 3, but shows another embodiment of the invention.

Figure 1:
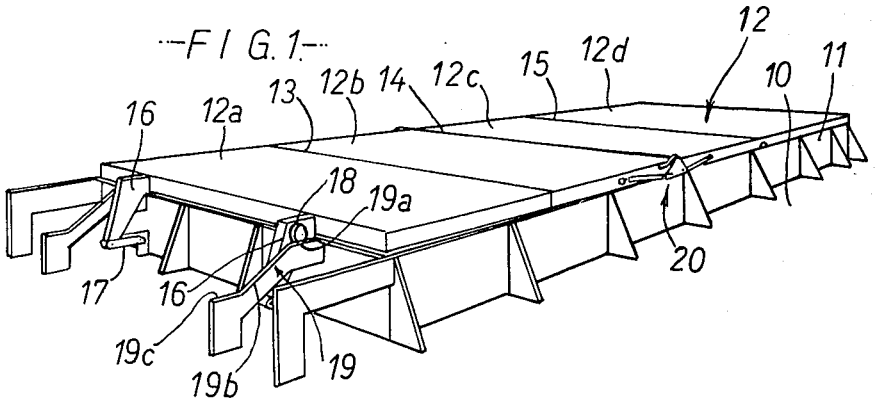

Referring to FIG. 1, a ship's deck 10 has a hatch coaming 11. The hatch coaming 11 is covered by a cover 12 which consists of four sections 12*a*–12*d*. The sections 12*a*–12*d* are hinged together at the joint lines 13, 14, 15 and the innermost section 12*a* is hingedly connected by means of brackets 16 to the hatch coaming 11 via joint arms 17. The brackets 16 are provided with a support wheel 18 which can roll along a separate roller path 19. The roller path has an upper horizontal support portion 19*a* and from this support portion an oblique downwardly extending transition portion 19*b* and a lower horizontal support portion 19*c*.

At the transverse center line of the cover 12, that is to say at the joint line 14 between the sections 12*b* and 12*c*, there is arranged a set of cover lifting devices 20 which will be described further in detail with reference to FIG. 2 – 8. In the present case there is only shown one set of cover lifting devices in the hatch cover, but it is apparent that there can be employed, as required, two or more such sets if there are more than four hatch cover sections hinged together in series. It will also be appropriate to employ such cover lifting devices with a number of three hatch cover sections hinged together in series.

Figure 2:
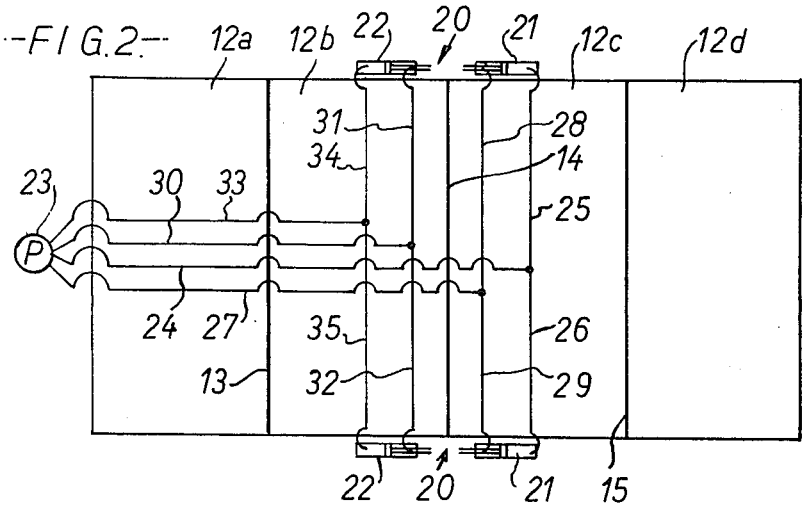

In FIG. 2, there is shown schematically a coupling diagram for two cover lifting devices 20 which are disposed on respective sides of the hatch cover. Each cover lifting device is provided with two lifting cylinders 21, 22 which are hingedly connected to their respective one of two adjacent cover sections 12c and 12b. The lifting cylinders 21 on the one side of the joint line 14 are adjusted independently of the lifting cylinders 22 on the other side of the joint line and are provided with their respective set of conduits. One end of the lifting cylinders 21 is connected to a pump- and valve-aggregate 23 via a first common conduit 24 and branch conduits 25, 26 coupled mutually in parallel, while the opposite end of the lifting cylinders 21 is connected to the aggregate 23 via a second common conduit 27 and branch conduits 28, 29 coupled mutually in parallel. Correspondingly, the lifting cylinders 22 are connected via a first conduit 30 and branch conduits 31, 32 and via a second conduit 33 and branch conduits 34, 35 to the aggregate 23.

Figure 3:
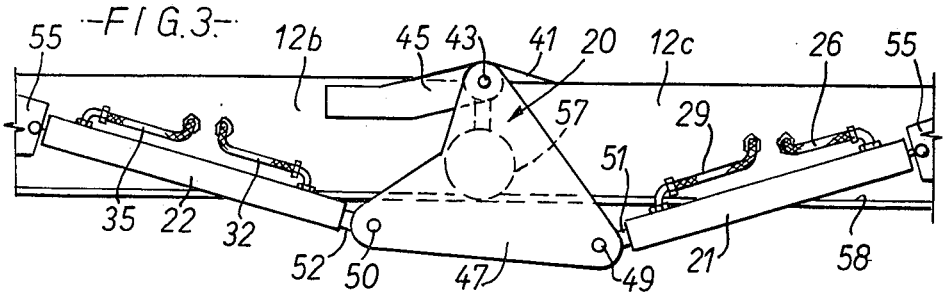

In FIGS. 3–5 the cover lifting device is illustrated in detail. The cover sections 12b and 12c are hinged together at the top edge via hinge ears 41, 42 and a common hinge pin 43. The hinge pin 43 projects further outwards through a double-support bracket 44, 45 and a double-support, plate-shaped hinge arm construction 46, 47. The one support 44 of the bracket is secured to the section 12b, while the other support 45 of the bracket is received in the intermediate space between the supports 46 and 47 of the hinge arm construction. Between the support 44 and the support 46, there is arranged a spacing means 48 so as to ensure the positioning of the hinge arm construction in an axial direction on the hinge pin 43. The hinge arm construction can be freely pivoted at the upper end about the hinge pin 43. At the lower end of the hinge arm construction, at opposite ends of the latter, piston rods 51, 52 of the lifting cylinders 21, 22 are hinged via pins 49, 50 while opposite ends of the lifting cylinders 21, 22 are connected via fastening ears 53 and pins 54 with brackets 55 of the hatch cover section 12c and the hatch cover section 12b respectively. On the innermost side of the support 46 of the hinge arm construction, there is rotatably mounted, on a pin 56, a support wheel 57 which rolls on a guide 58 along the top of the hatch coaming 11. The guide 58 consists of a rail-forming steel profile. In the position shown in FIG. 3, the wheel 57 rests directly against the top surface of the hatch coaming at a portion where the guide 58 is interrupted. In the position which is shown in FIG. 3, a sealing element 59 rests on the under side of the hatch cover section directly against an upwardly projecting sealing flange 60 on the hatch coaming, while in the position of the wheel 57 which is shown in FIG. 5, the sealing element 59 has arrived at a level above the sealing flange 60.

By connecting the hinge arm construction to the sections 12b and 12c via the hinge pin 43 which forms the hinge link between the sections, there can be achieved an advantageous connection between the components and an effective distribution of force from the sections to the hinge arm connection.

By correspondingly placing the support wheel 57 vertically below the hinge pin 43, there is achieved an advantageous connection between the sections and the support wheel via the hinge pin and the hinge arm construction so that there is obtained an effective force distribution between the components.

From FIGS. 3 and 5, it is evident that much of the cover lifting device 20 is arranged laterally outside the hatch coaming 11 and its wheel guide 58 and, furthermore, it is evident that the hinge arm construction is extended a substantial distance downwards below the level of the guide 58. This involves being able to utilise advantageous attack angles for the lifting cylinders 21 and 22, independently of the height of the cover sections above the hatch coaming. Further, arbitrarily large lifting cylinders can be utilised as required.

In FIG. 6, the hatch cover is shown in place in the active sealing position with the cover sections arranged horizontally.

In FIG. 7, the hatch cover is shown after the one half of the hatch cover has been guided into place in a stable position outside the hatch opening. The folding together of the first two sections 12a and 12b is effected by virtue of one lifting cylinder 22 of the cover lifting device 20 lifting upwards the section 12b to a vertical position via the hinge arm connection 46, 47. By varying the size of the section, the sections 12a and 12b can be lifted without lifting the section 12c. After the sections 12a and 12b have been lifted up to the vertical position, they are simultaneously pushed inwards along the guide path 19 to the position which is shown in FIG. 7. On thereafter actuating the lifting cylinders 21, it is easy to lift the sections 12c and 12d upwards to the position which is shown in FIG. 8 with all the sections 12a–12d in place in a stable position disposed outside the hatch opening.

Reverse pivoting of the cover sections from the position shown in FIG. 8 to the position shown in FIG. 6 is effected in a similar manner to that which is indicated above.

If desired the sections 12a, 12b and the sections 12c and 12d can be pivoted in one and the same operation both during the pivoting to the stable position and during pivoting from the stable position.

Figure 9:
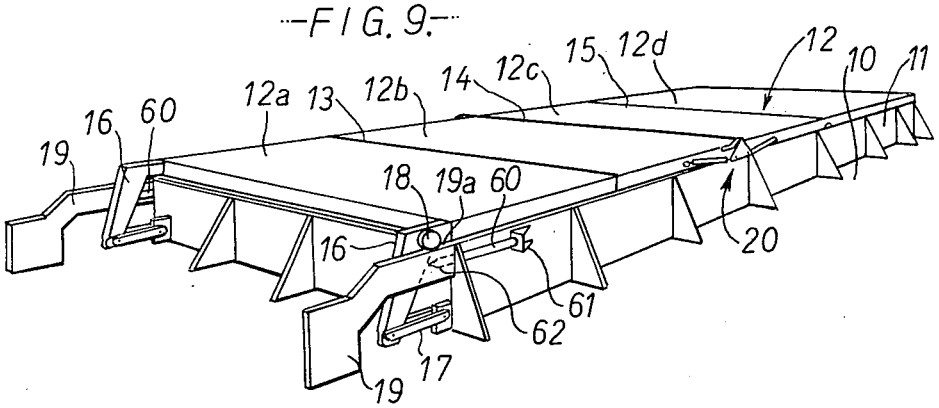
FIG. 9 is a perspective view of a ship's hatch coaming with the cover arrangement of an alternative embodiment mounted thereon in an active position.
Figure 10:
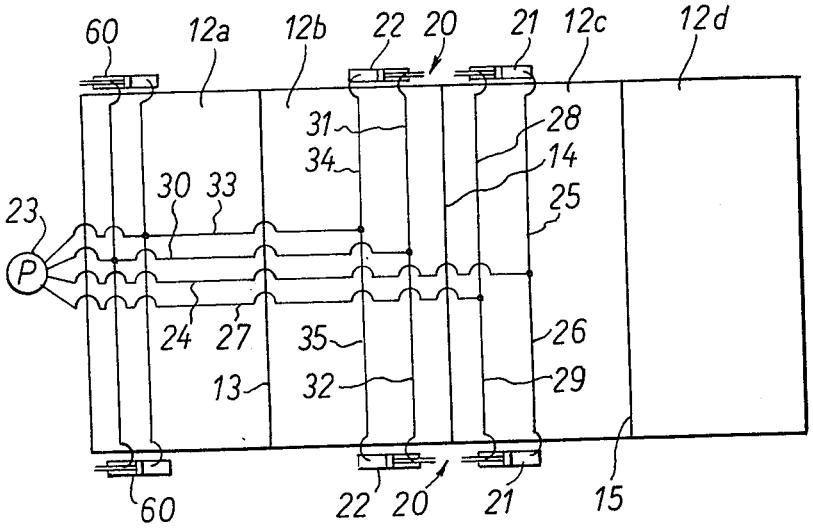
FIG. 10 is a schematic coupling diagram of the arrangement of FIG. 9 viewed from above.

In FIGS. 9 and 10, there is illustrated a modified form of hatch cover arrangement. A main difference from the construction of the other embodiment is that the section 12a is actuated, via its brackets 16, by an extra lifting cylinder 60 at each bracket 16. The one end of the lifting cylinder is hinged to the side of the hatch coaming 11 at 61, while the piston rod 62 of the lifting cylinder is hinged at the opposite end to the bracket 16. The bracket 16 is arranged flush with the edge portion of the section 12a reckoned in the direction of the length of the hatch coaming. The lifting cylinders 60 are connected as shown in FIG. 10 to the conduits 30 and 33, so that the cylinders are actuated simultaneously with the lifting cylinders 22.

As is especially evident from FIG. 8, the sections 12a and 12b are shorter and hence lighter in weight than the sections 12c and 12d so that the sections 12c, 12d automatically receive the greatest loading and thereby ensure that they are folded downwards first to the position shown in FIG. 7 and that the sections 12a and 12b are correspondingly folded upwards first from the position shown in FIG. 6 to the position shown in FIG. 8. In the embodiment of FIG. 9 and 10, there can be provided simultaneous movement of the sections 12a, 12b and 12c, 12d independently of the mutual size of the sections. Another advantage is that the sections 12a–12d can be made with one and the same size.

In FIG. 11 there is illustrated a further modified form of hatch cover arrangement wherein each hinge arm construction has more than one support wheel. The illustrated hinge arm construction which includes support 47' has two support wheels 57', 57' disposed below the hinge pin 43' to roll on a guide 58' along the top edge of the hatch coaming.

What we claim is:

1. A hatch cover arrangement which comprises a cover made up of cover sections directly hinged together in series and adapted to be pivoted from an active horizontal position above a hatch coaming defining a hatch opening to an inactive, upwardly swung, vertical position at least partially outside said opening, a cover lifting device arranged in opposite relation on each exposed longitudinal side of said cover and comprising two lifting arms in combination with not more than two lifting cylinders, said lifting arms each being hingedly connected at one end to a respective one of two adjacent cover sections and at the opposite end to a hinge arm construction common to said arms which construction is separately hinged to said adjacent cover sections and a wheel mounted for the support of said hinge arm construction between the latter and said longitudinal side of said cover at the junction between said adjacent cover sections and designed for rotation along a guide extending longitudinally of said coaming, and means for actuating said not more than two lifting cylinders of said cover lifting device to cause said lifting arms to pivot the cover sections reversibly between said inactive and active positions while rotating said wheel along said guide towards and away from one end of said coaming, the common hinge construction and associated lifting arms of each cover lifting device being arranged laterally outside said guide and the locations at which said lifting arms are hingedly connected to said construction being below the level of said guide.

2. An arrangement according to claim 1, wherein the hinge arm construction of each cover lifting device is pivotally mounted on a pin hinging together the two adjacent cover sections.

3. An arrangement according to claim 2, wherein each hinge arm construction has more than one support wheel disposed below the hinge pin.

4. An arrangement according to claim 1, wherein the cover sections are four in number and each cover lifting device is arranged to bridge the second and third of said sections, the first and second sections being shorter in length than the third and fourth sections and all four sections being reversibly pivotable between the inactive and active positions at the same time.

5. An arrangement according to claim 1, wherein each cover lifting device also includes an auxiliary lifting cylinder hingedly connected at one end to the hatch coaming adjacent the one end thereof and at the other end to a bracket hingedly connected to an end cover section, said auxiliary lifting cylinder being operatable by the actuation means simultaneously with the not more than two lifting cylinders of the two adjacent cover sections.

6. An arrangement according to claim 5, wherein the cover sections are four in number and are of one and the same size, said sections being reversibly pivotable between the inactive and active positions at the same time.

7. An arrangement according to claim 1, wherein each cover lifting device comprises two lifting cylinders.

* * * * *